US007641485B2

(12) United States Patent
Shibata

(10) Patent No.: US 7,641,485 B2
(45) Date of Patent: Jan. 5, 2010

(54) LEVER-TYPE CONNECTOR AND A CONNECTOR ASSEMBLY

(75) Inventor: Takahiro Shibata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/349,177

(22) Filed: Jan. 6, 2009

(65) Prior Publication Data

US 2009/0181566 A1 Jul. 16, 2009

(30) Foreign Application Priority Data

Jan. 11, 2008 (JP) ..... 2008-004687

(51) Int. Cl.
*H01R 13/62* (2006.01)

(52) U.S. Cl. ..... 439/157

(58) Field of Classification Search ..... 439/157, 439/152, 153–156, 159
See application file for complete search history.

(56) References Cited

U.S. PATENT DOCUMENTS 5,848,908 A * 12/1998 Katsuma ..... 439/157
6,783,388 B2 * 8/2004 Matsushita ..... 439/489
7,214,078 B2 * 5/2007 Fukatsu ..... 439/157
7,234,952 B2 * 6/2007 Sasaki et al. ..... 439/157
7,300,294 B2 * 11/2007 Fukatsu et al. ..... 439/157
7,448,888 B2 * 11/2008 Okano ..... 439/157
2008/0081498 A1 * 4/2008 Fukatsu et al. ..... 439/157

FOREIGN PATENT DOCUMENTS

JP 8-162209 6/1996

* cited by examiner

*Primary Examiner*—Neil Abrams
*Assistant Examiner*—Phuong Nguyen
(74) *Attorney, Agent, or Firm*—Gerald E. Hespos; Anthony J. Casella

(57) ABSTRACT

Locking projections (31) formed on resiliently deformable resilient arms (30) hold a lever (20) at an initial position by engaging locking recesses (18). Resilient escaping portions (19), on which the locking projections (31) slide in the process of rotating the lever (20) between an assembled position and the initial position, are resiliently deformable in directions away from the locking projections (31). Upon rotating the lever (20) from the assembled position to the initial position after the lever (20) is assembled with a first housing (10), both the resilient arms (30) and the resilient escaping portions (19) are resiliently deformed. Thus, as compared with the case where only the resilient arms (30) are resiliently deformed, degrees of resilient deformation of the resilient arms (30) are reduced, wherefore deformations of the locking projections (31) to be crushed can be suppressed.

14 Claims, 10 Drawing Sheets

LEVER-TYPE CONNECTOR AND A CONNECTOR ASSEMBLY

BACKGROUND OF THE INVENTION

1. Field of the Invention

The invention relates to a lever-type connector and to a connector assembly.

2. Description of the Related Art

Japanese Unexamined Patent Publication No. H08-162209 discloses a lever-type connector with first and second housings that can be connected with one another. The first housing is formed with a supporting shaft and a lever is formed with a bearing hole mounted rotatably on the supporting shaft. The lever is formed with a cam groove and the second housing is formed with a cam follower that can engage in the cam groove. The first and second housing are fit lightly together with the lever at an initial position so that the cam follower enters the cam groove. The lever then is rotated to a connected position.

A retaining projection is formed at the leading end of the supporting shaft and a cutout is formed in the inner circumference of the bearing hole. The retaining projection and the cutout are aligned to permit engagement of the supporting shaft and the bearing hole only when the lever is at an assembled position that is reached by rotating the lever from the initial position in a direction opposite to the rotational direction toward the connection position. The retaining projection is not aligned with the cutout and engages the opening edge of the bearing hole in the process of rotating the lever between the initial position and the connection position, i.e. in the process of connecting or separating the two housings. Therefore the bearing hole is not disengaged from the supporting shaft.

The connecting operation of the above-described connector is started with the lever at the initial position. Thus, a positioning projection is formed on the first housing and a positioning hole is formed on the lever. The positioning projection engages the positioning hole to hold the lever at the initial position. However, the positioning projection abrades against the inner surface of the lever in the process of rotating the lever from the assembled position to the initial position. Hence the positioning projection may be deformed and crushed. An engagement margin between the positioning projection and the positioning hole decreases if the positioning projection is crushed, and the lever is held less reliably at the initial position.

A resiliently deformable locking projection might be provided on the first housing or the lever and a locking recess could be provided on the other of the first housing and the lever for engaging the locking projection in an effort to avoid the above-described problem. According to this construction, the locking projection can be deformed resiliently to escape from a mating member in the process of rotating the lever from the assembled position to the initial position. Therefore, the locking projection is not likely to be broken.

However, the locking projection of this possible connector would be pressed against the mating member due to its resilient restoring force. Thus, the locking projection may possibly be deformed upon mounting the lever.

The invention was developed in view of the above, and an object thereof is to improve the reliability of holding a lever at an initial position.

SUMMARY OF THE INVENTION

The invention relates to a lever-type connector or connector of the movable member type. The connector has a housing that is connectable with a mating housing. The housing includes a supporting shaft and a lever or movable member is mounted displaceably on the housing. The lever has a cam functioning portion that can engage a cam follower of the mating housing by lightly connecting the housing with the mating housing while the lever is at an initial position. The lever then is displaced toward a connection position and this displacement generates a cam action between the cam functioning portion and the cam follower housing for urging the housing toward a connected position with the mating housing. A retaining projection is formed on the outer surface of the leading end of the supporting shaft and a cutout is formed in the lever. The cutout does not correspond to the retaining projection in the process of displacing the lever between the initial position and the connection position and permits passage of the retaining projection only when the lever is at an assembled position at a side of the initial position opposite to the connection position. A resilient arm is formed on the housing or the lever and is deformable in a direction intersecting a displacement direction of the lever. A locking projection is formed on the resilient arm and a locking recess is formed in the other of the housing and the lever. The locking recess can engage the locking projection only when the lever is at the initial position and holds the lever. A resilient escaping portion is formed at one of the housing and the lever with the locking recess. The escaping portion can resiliently deform away from the locking projection and can slide on the locking projection as the lever is displaced between the assembled position and the initial position.

Upon assembling the lever with the housing, the bearing hole is engaged with the supporting shaft while the retaining projection is passed through the cutout with the lever held at the assembled position. Thereafter, both the resilient arm and the resilient escaping portion are deformed away from each other upon displacing the lever from the assembled position toward the initial position. Thus, a degree of resilient deformation of the resilient arm is reduced, and hence the restoring force of the resilient arm is reduced as compared with the case where only the resilient arm is deformed. Therefore, the locking projection is not likely to be crushed by the resilient restoring force of the resilient arm and the lever is held reliably at the initial position.

The lever preferably is mounted rotatably on the housing by the engagement of a bearing hole, and the cutout is formed in the lever in the inner circumferential surface of the bearing hole.

The resilient escaping portion preferably is arranged before the supporting shaft in a connecting direction of the housing with the mating housing and is arranged to correspond to the locking projection in a direction at an angle to the connecting direction of the housing with the mating housing when the bearing hole and the supporting shaft are aligned at the same position to hold the lever in substantially the same posture as at the assembled position with the housing.

The locking projection contacts the resilient escaping portion when the lever is assembled with the housing from the front in substantially the same posture as at the assembled position. Thus, the resilient arm and the resilient escaping portion deform resiliently in the assembling process. Accordingly, the resilient arm and the resilient escaping portion are deformed in the process of displacing the lever from the assembled position to the initial position and also in the process of assembling the lever with the housing.

The housing preferably has an escaping groove that extends toward the supporting shaft from the front end of the housing for avoiding interference with the cam follower.

The locking recess preferably is formed by cutting the housing from the front end in substantially the same direction as the escaping groove.

A resilient escaping portion preferably is cantilevered forward in an area between the escaping groove and the locking recess. Thus, the resilient escaping portion is deformed more easily as compared with a resilient escaping portion having both ends supported on the housing and the degree of resilient deformation of the resilient arm is reduced by that much.

The mating housing preferably has an unlocking projection that enters the locking recess in the process of connecting the housing with the mating housing. The unlocking projection displaces the locking projection in a direction to disengage from the locking recess and permits the lever to be displaced toward the connection position. Accordingly, it is not necessary to perform an operation of disengaging the locking projection from the locking recess.

The resilient arm and the resilient escaping portion could be made to deform in radial directions toward and away from the supporting shaft. However, such a design would require the lever and the housing to be enlarged in radial directions to ensure space for the deformations of the resilient arm and the resilient escaping portion. Accordingly, deforming directions of the resilient arm and the resilient escaping portion preferably are substantially parallel to the axis of the supporting shaft. Therefore, the lever and the housing need not be enlarged in radial directions.

The invention also relates to a connector assembly comprising the above-described lever-type connector and a mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
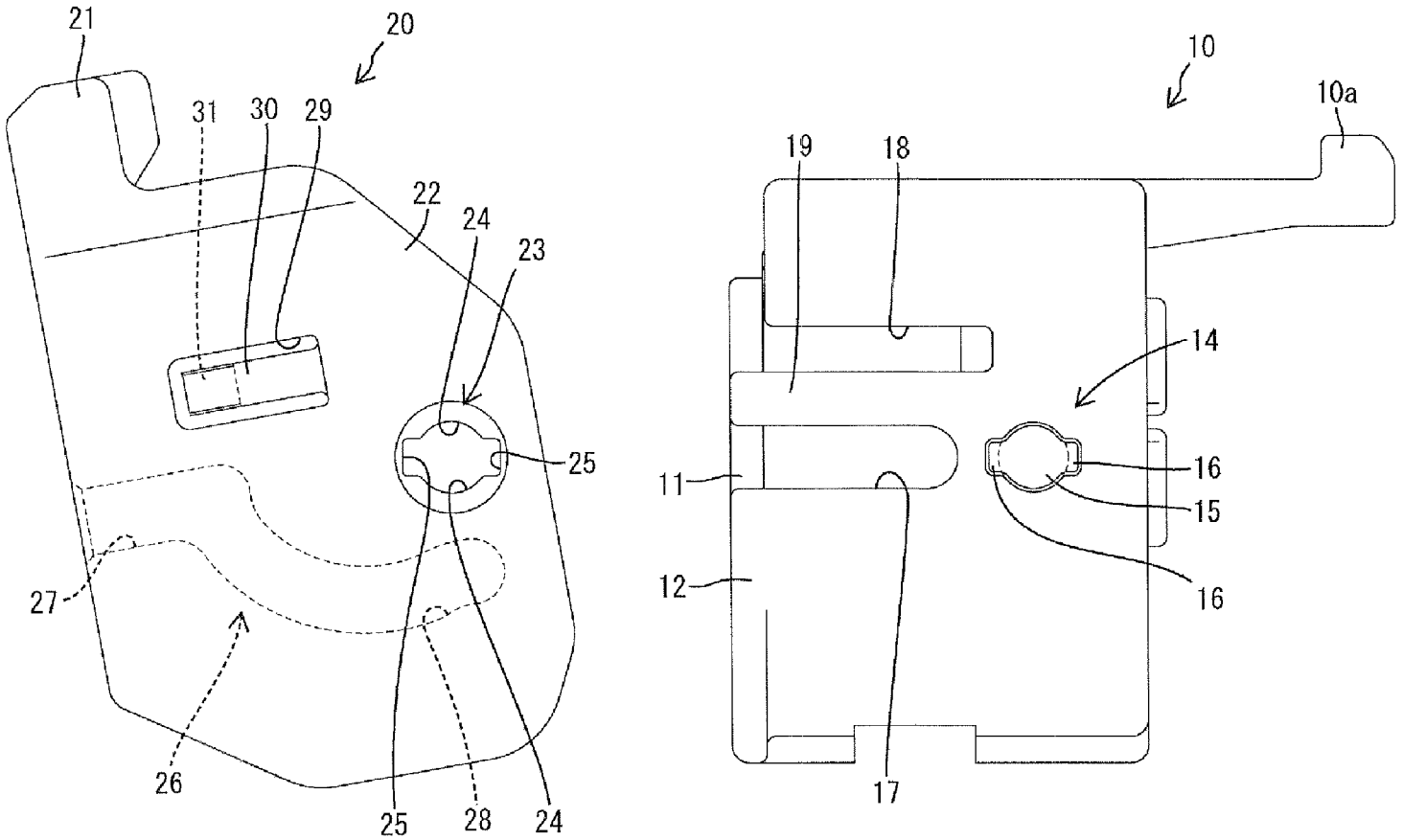
FIG. 1 is a side view showing a state before a first housing and a lever are assembled in one embodiment.
Figure 2:
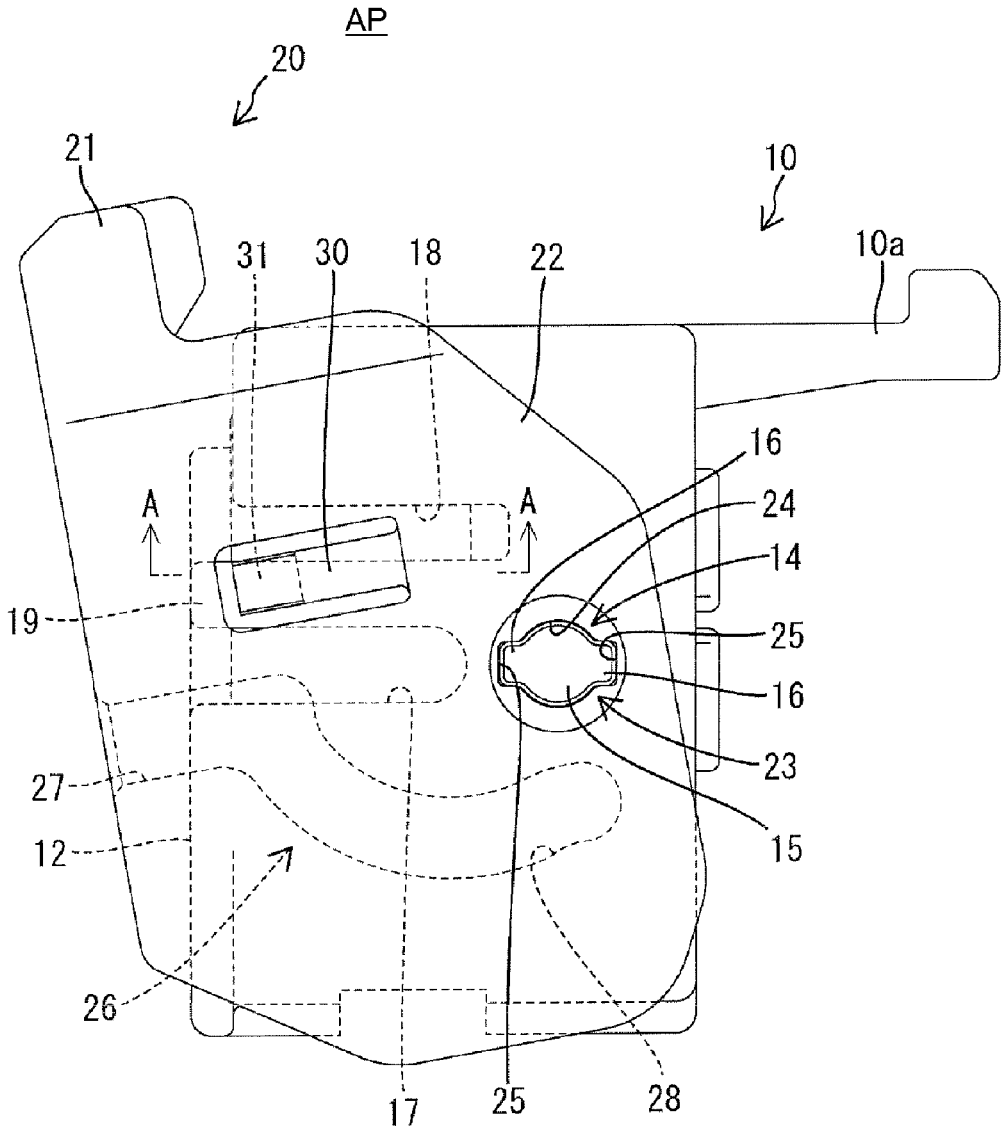
FIG. 2 is a side view showing a state where the lever assembled with the first housing is held at an assembled position.

A lever-type connector assembly in accordance with the invention is illustrated in FIGS. 1 to 12. The connector assembly includes a first housing 10, a lever 20 mounted on the first housing 10 and a second housing 40 connectable with and separable from the first housing 10 along a connecting direction CD. Ends of the housings to be connected with each other are referred to herein as the front ends.

The first housing 10 is made unitarily e.g. of synthetic resin and has a substantially block-shaped terminal accommodating portion 11. Female terminal fittings (not shown) are accommodated in the terminal accommodating portion 11. A substantially tubular fitting 12 extends forward from a rear end of the terminal accommodating portion 11 and at least partly surrounds the terminal accommodating portion 11. A tubular connection space 13 is formed between the outer surface of the terminal accommodating portion 11 and the inner peripheral surface of the tubular fitting 12. The connection space 13 is open at the front end of the first housing 10 for receiving part of the second housing 40.

Supporting shafts 14 project laterally out from the opposite left and right walls of the tubular fitting 12 and are substantially orthogonal to the connecting direction CD of the two housings 10, 40. The supporting shafts 14 are near the center in the vertical direction and are near the rear end in the connecting direction CD with the second housing 40. Each supporting shaft 14 has a cylindrical shaft main body 15 and two retaining projections 16 project radially out in opposite directions from positions at or near the projecting end of the shaft main body 15. The retaining projections 16 extend in forward and backward directions and hence are aligned substantially parallel to the connecting directions CD of the two housings 10, 40.

Escaping grooves 17 are formed in each of the opposite left and right walls of the tubular fitting 12 and extend substantially straight back in directions substantially parallel to the connecting direction CD of the two housings 10, 40. The escaping grooves 17 are at the same height as the supporting shafts 14 in a vertical direction. Additionally, the escaping grooves 17 open at the front end edge of the tubular fitting 12 and provide communication between the outer surface of the tubular fitting 12 and the connection space 13. Rear ends of the escaping grooves 17 are near the front sides of the supporting shafts 14.

Each of the opposite left and right walls of the tubular fitting 12 also is formed with a locking recess 18 at a position different from the supporting shaft 14 and the escaping groove 17 in the vertical direction. The locking recesses 18 extend substantially straight back from the front end of the tubular fitting 12 in directions substantially parallel to the connecting direction CD of the two housings 10, 40 and in substantially the same direction as the escaping grooves 17. The locking recesses 18 are open at the front end of the tubular fitting 12 and provide communication between the outer surface of the tubular fitting 12 and the connection space 13. The rear ends of the locking recesses 18 are more backward than the rear ends of the escaping grooves 17 and more forward than the axial lines of the supporting shafts 14.

Areas on each of the left and right walls of the tubular fitting 12 between the escaping grooves 17 and the locking recesses 18 define forwardly cantilevered resilient escaping portions 19 that are resiliently deformable about their rear ends. The escaping portions 19 can deform resiliently in lateral directions substantially parallel with the axial lines of the supporting shafts 14 and substantially orthogonal to the connecting and separating directions CD of the two housings 10, 40. The escaping portions 19 are more forward than the supporting shafts 14 in the connecting direction CD of the two housings 10, 40.

The lever 20 is made e.g. of synthetic resin to include an operable portion 21 and two laterally symmetrical plate-like arms 22 that project unitarily from the operable portion 21. The arms 22 extend parallel with each other from opposite lateral ends of the operable portion 21. A bearing hole 23 penetrates each arm 22 from the outer surface to the inner surface. Each bearing hole 23 has two symmetrically opposed circularly generated arcuate sections 24 and two symmetrically opposed substantially rectangular cutouts 25.

The bearing holes 23 can be engaged rotatably with the supporting shafts 14 of the first housing 10 by deforming the arms 22 away from each other, locating the bearing holes 23 on the same axis as the supporting shafts 14 and aligning the cutouts 25 with the retaining projections 16. The arms 22 are adjacent to and facing the outer surfaces of the opposite side walls of the tubular fitting 12 when the lever 20 is mounted on the first housing 10 and the operable portion 21 is arranged above the first housing 10.

The lever 20 has an assembled position AP (see FIGS. 2 and 4) where the operable portion 21 is located above the first housing 10 and the cutouts 25 and the retaining projections 16 are aligned so that the retaining projections 16 can pass the cutouts 25. The lever 20 can be rotated back by a small angle from the assembled position AP to an initial position IP (see FIGS. 5 and 7 to displace the operable portion 21 back. The lever 20 also can be rotated a large amount from the assembled position AP toward a side opposite to the initial position IP and to a connection position CP (see FIG. 10). Preferably, the sum of an angle of rotation from the assembled position AP to the initial position IP (about 10° to about 20° in this embodiment) and an angle of rotation from the initial position IP to the connection position CP (about 80° to about 100°, preferably about 90° in this embodiment) is smaller than 180°.

A cam groove 26 is formed in the surface of each arm 22 that faces the side wall of the tubular fitting 12 and extends back from the front edge of the respective arm 22 that is substantially orthogonal to the connecting direction CD of the two housings 10, 40 when the lever 20 is at the initial position IP. Each cam groove 26 has an entrance 27 extending substantially straight from the front edge of the arm 22 toward the bearing hole 23 and a cam operating portion 28 that extends from the rear end of the entrance 27 in an arcuate manner to gradually approach the bearing hole 23. The entrances 27 of the cam grooves 26 correspond to the escaping grooves 17 when the lever 20 is at the initial position IP.

A substantially U-shaped cut-out 29 penetrates each arm 22 from the inner surface to the outer surface in an area above the cam groove 26 and the bearing hole 23 and before the bearing hole 23 when the lever 20 is at the initial position IP. A resilient arm 30 is cantilevered forward in each cutout 29. The resilient arms 30 are resiliently deformable in lateral directions substantially parallel to the axes of the supporting shafts 14 and substantially orthogonal to the connecting and separating directions CD of the two housings 10, 40 with the rear ends of the arms 30 as supports. A locking projection 31 is formed at a front extending end of each resilient arm 30 and projects in when the resilient arm 30 is in a free undeformed state.

The resilient arms 30 face the locking recesses 18 and the locking projections 31 engage the upper and lower edges of the locking recesses 18 when the lever 20 is at the initial position IP. This engagement holds the lever 20 at the initial position IP and prevents displacement toward the assembled position AP and the connection position CP. The locking projections 31 are located before and above the bearing holes 23 and are between the locking recesses 18 and the escaping grooves 17. Thus, the locking projections 31 face the resilient escaping portions 19 when the lever 20 is at the assembled position AP.

The second housing 40 is made e.g. of synthetic resin and has a terminal holding portion 41 for holding male terminal fittings (not shown). A rectangular tubular receptacle 42 projects unitarily forward from the terminal holding portion 41. Cam followers 43 project from the outer surfaces of the opposite left and right walls of the receptacle 42. The cam followers 43 are substantially cylindrical and are at positions corresponding to the supporting shafts 14 and the escaping grooves 17 in the vertical direction, which is substantially orthogonal to the connecting direction CD with the first housing 10. Long narrow unlocking ribs 44 extend in forward and backward directions at positions above the cam followers 43 on the opposite left and right outer surfaces of the receptacle 42. The unlocking ribs 44 are at vertical positions corresponding to the locking recesses 18.

The lever 20 is mounted on the first housing 10 and is held in the same posture as the assembled position AP relative to the first housing 10, as shown in FIG. 1, so that the cutouts 25 of the bearing holes 23 align with the retaining projections 16 in circumferential directions of the supporting shafts 14. The lever 20 is positioned vertically relative to the first housing 10 so that the bearing holes 23 are at substantially the same height as the supporting shafts 14. In this state, the lever 20 is brought closer to the first housing 10 from the front along a moving direction substantially parallel to the connecting direction CD of the two housings 10, 40. In other words, the lever 20 is assembled with the first housing 10 while being moved along a path so as not to change the heights of the supporting shafts 14 and the bearing holes 23.

The lever 20 temporarily deforms during assembly to widen the spacing between the arms 22, and the bearing holes 23 are fit on the shaft main bodies 15 of the supporting shafts 14. The arms 22 then restore resiliently and move toward one another. As a result, the retaining projections 16 pass the cutouts 25 to mount the lever 20 on the first housing 10 at the assembled position AP. The retaining projections 16 pass the bearing holes 23 as the lever 20 is assembled. The lever 20 then is rotated away from the assembled position AP so that the retaining projections 16 engage the opening edges of the arcuate sections 24 of the bearing holes 23 from the outside the arms 22.

Figure 3:
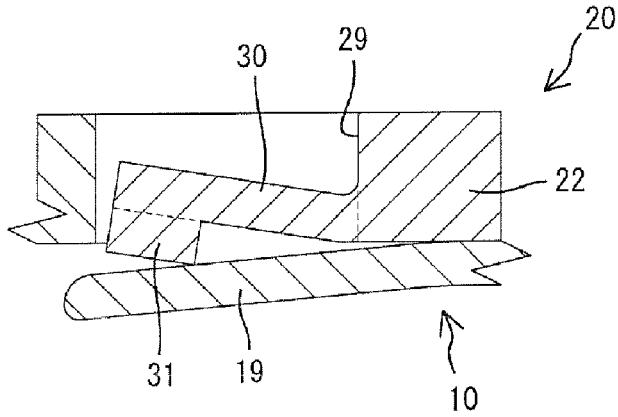
FIG. 3 is a section along A-A of FIG. 2.
Figure 4:
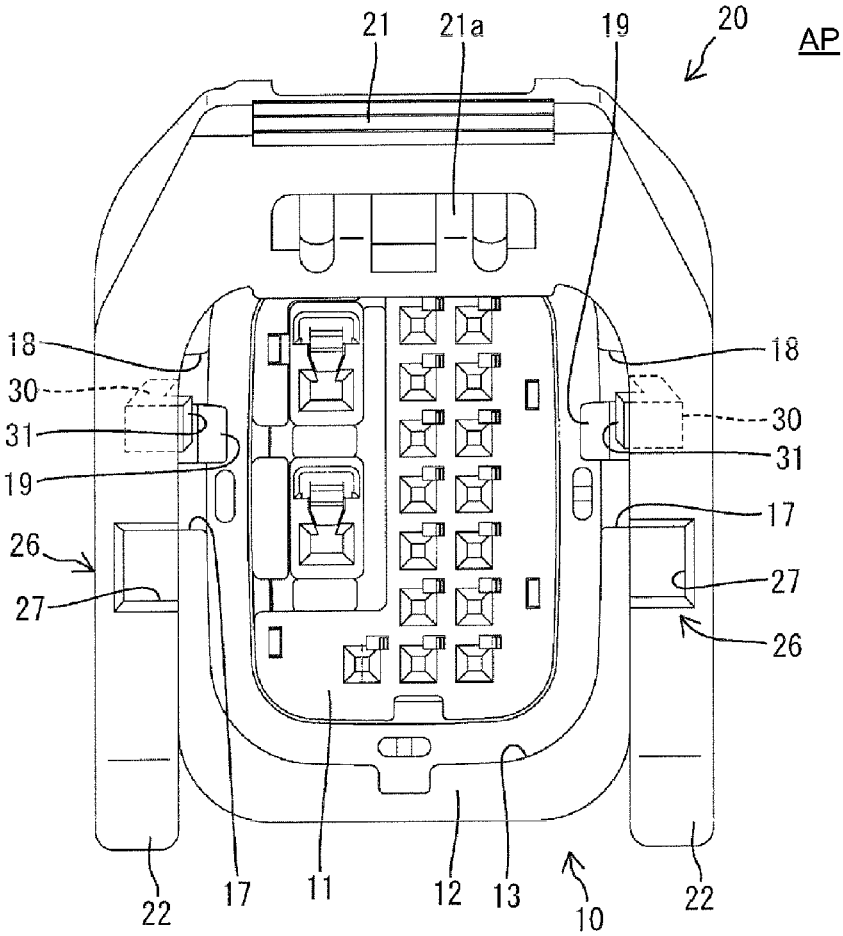
FIG. 4 is a front view of the first housing showing the state where the lever is held at the assembled position.

The locking projections 31 contact the outer surfaces of the resilient escaping portions 19 in the process of assembling the lever 20 on the first housing 10 and in a state where arms 22 of the lever 20 are not deformed away from each other. Thus, the resilient arms 30 deformed inwardly and the resilient escaping portions 19 deform outwardly. The arms 22 then are moved away from each other so that the bearing hole 23 can engage the supporting shafts 14. As a result, the arms 22, on which the locking projections 31 are formed, separate from the tubular fitting 12, on which the resilient escaping portions 19 are formed. Thus, degrees deformation of the resilient arms 30 and the resilient escaping portions 19 temporarily decrease. The resilient arms 30 and the resilient escaping portions 19 are deformed resiliently, as shown in FIG. 3, when the bearing holes 23 are engaged with the supporting shafts 14.

Figure 5:
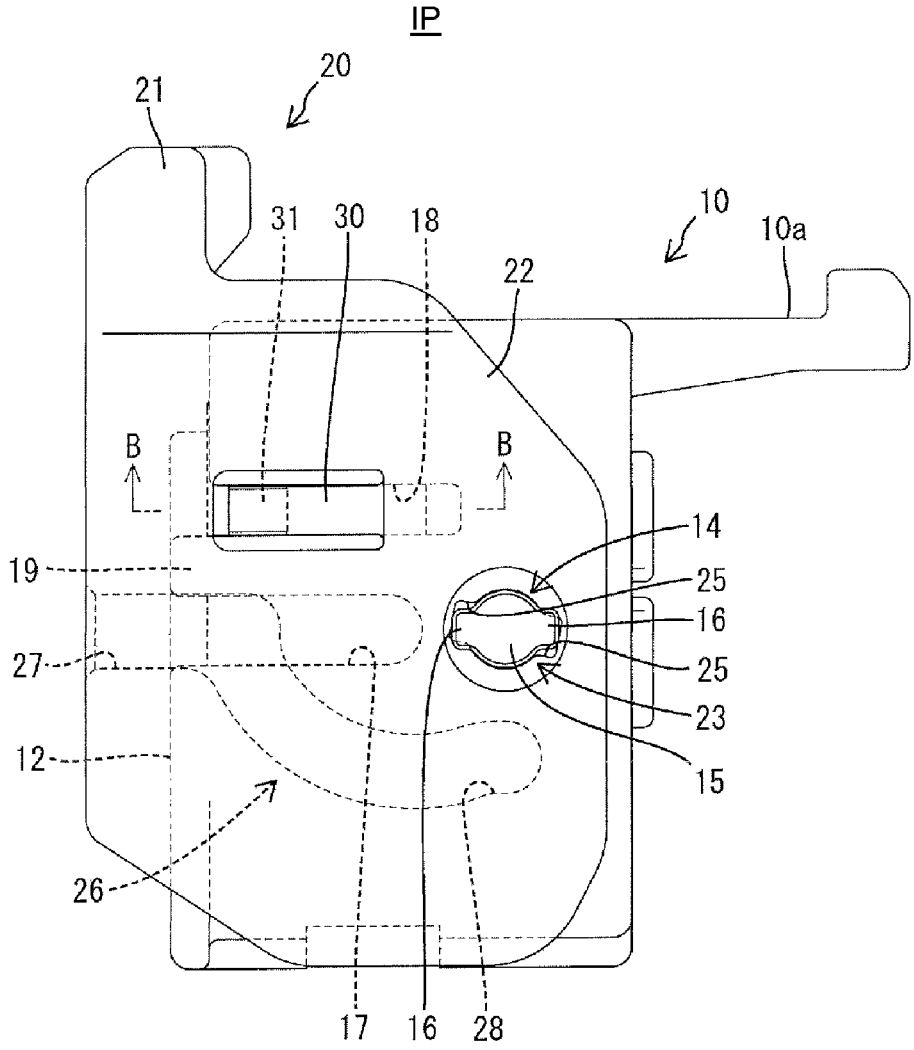
FIG. 5 is a side view showing a state where the lever is held at an initial position.
Figure 6:
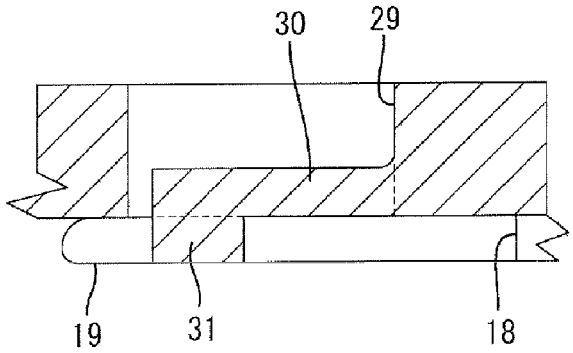
FIG. 6 is a section along B-B of FIG. 5.
Figure 7:
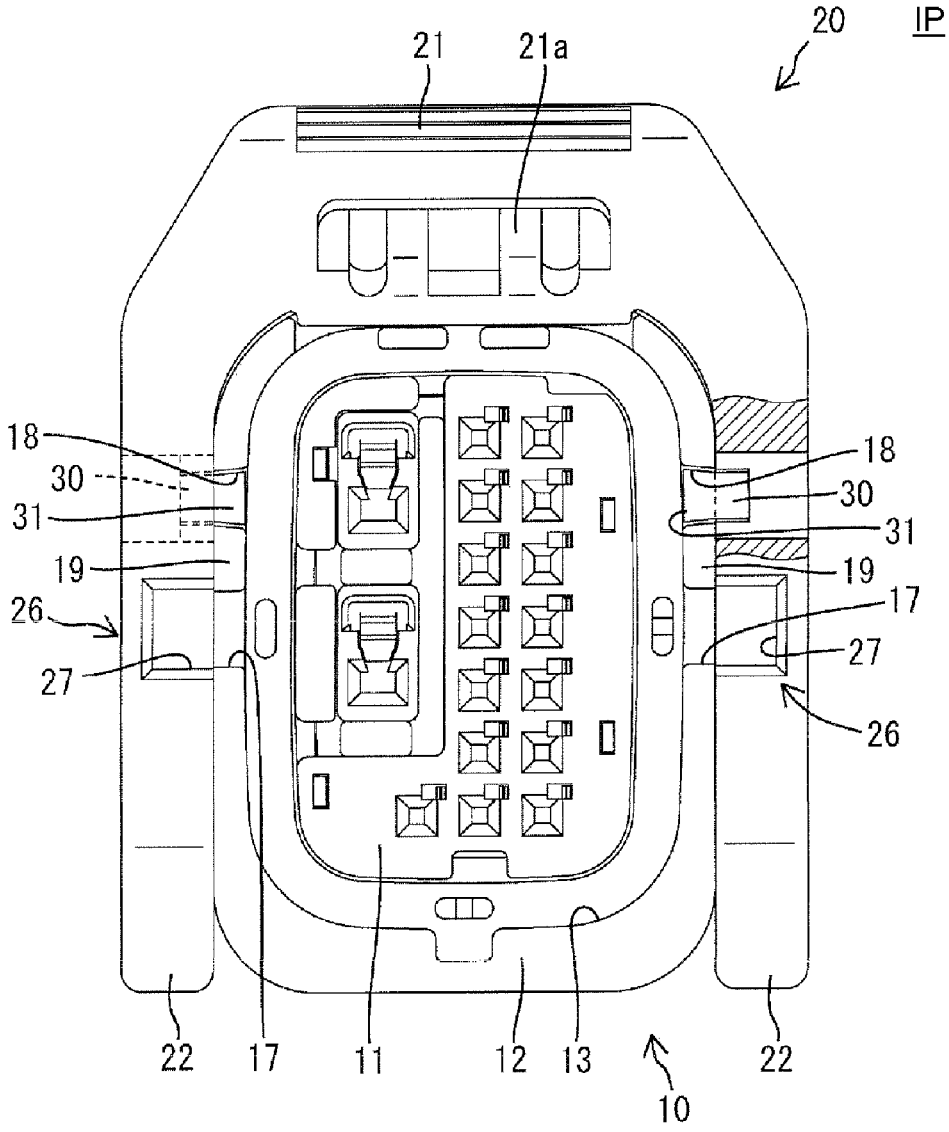
FIG. 7 is a front view of the first housing showing the state where the lever is held at the initial position.

The lever 20 is rotated from the assembled position AP to the initial position IP after the bearing holes 23 are engaged on the supporting shafts 14. As a result, the locking projections 31 slide on the outer surfaces of the resilient escaping portions 19 with the resilient arms 30 and the resilient escaping portions 19 kept resiliently deformed. The locking projections 31 disengage from the upper edges of the resilient escaping portions 19 when the lever 20 reaches the initial position IP so that the resilient arms 30 and the resilient escaping portions 19 restore resiliently, as shown in FIG. 6. Therefore, the lower surfaces of the locking projections 31 engage the lower edges of the locking recesses 18 (i.e. upper edges of the resilient escaping portions 19) from above and the upper surfaces of the locking projections 31 engage the upper edges of the locking recesses 18 from below, as shown in FIG. 5. These engagements prevent displacement of the lever 20 toward the assembled position AP and toward the connection position CP. As a result, the lever 20 is held at the initial position IP. The retaining projections 16 engage the outer edges of the bearing holes 23 when the lever 20 is at the initial position IP to prevent displacements of the bearing holes 23 relative to the supporting shafts 14 in an axial direction and to hold the lever 20 mounted on the supporting shafts 14.

Figure 8:
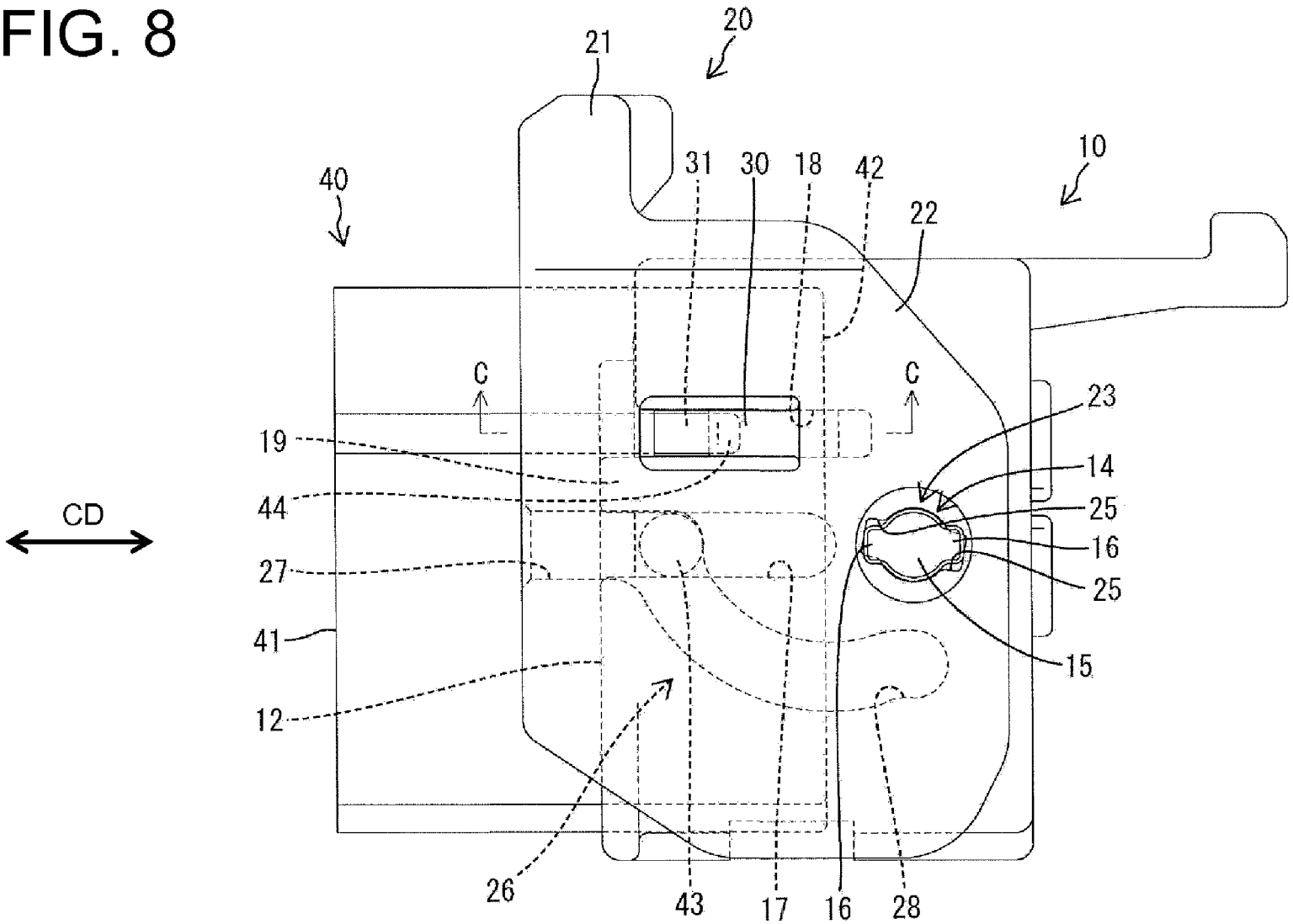
FIG. 8 is a side view showing a state where a second housing is lightly connected with the first housing.
Figure 9:
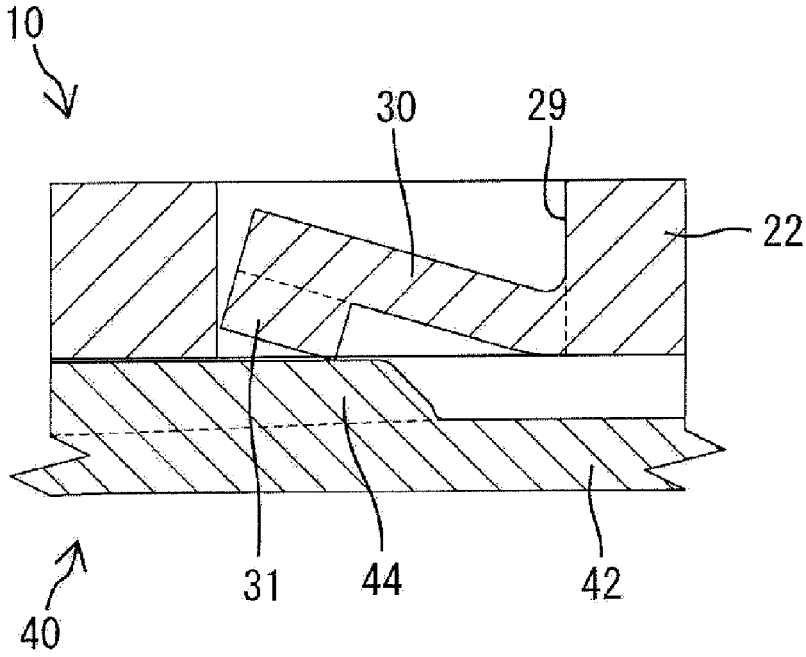
FIG. 9 is a section along C-C of FIG. 8.
Figure 10:
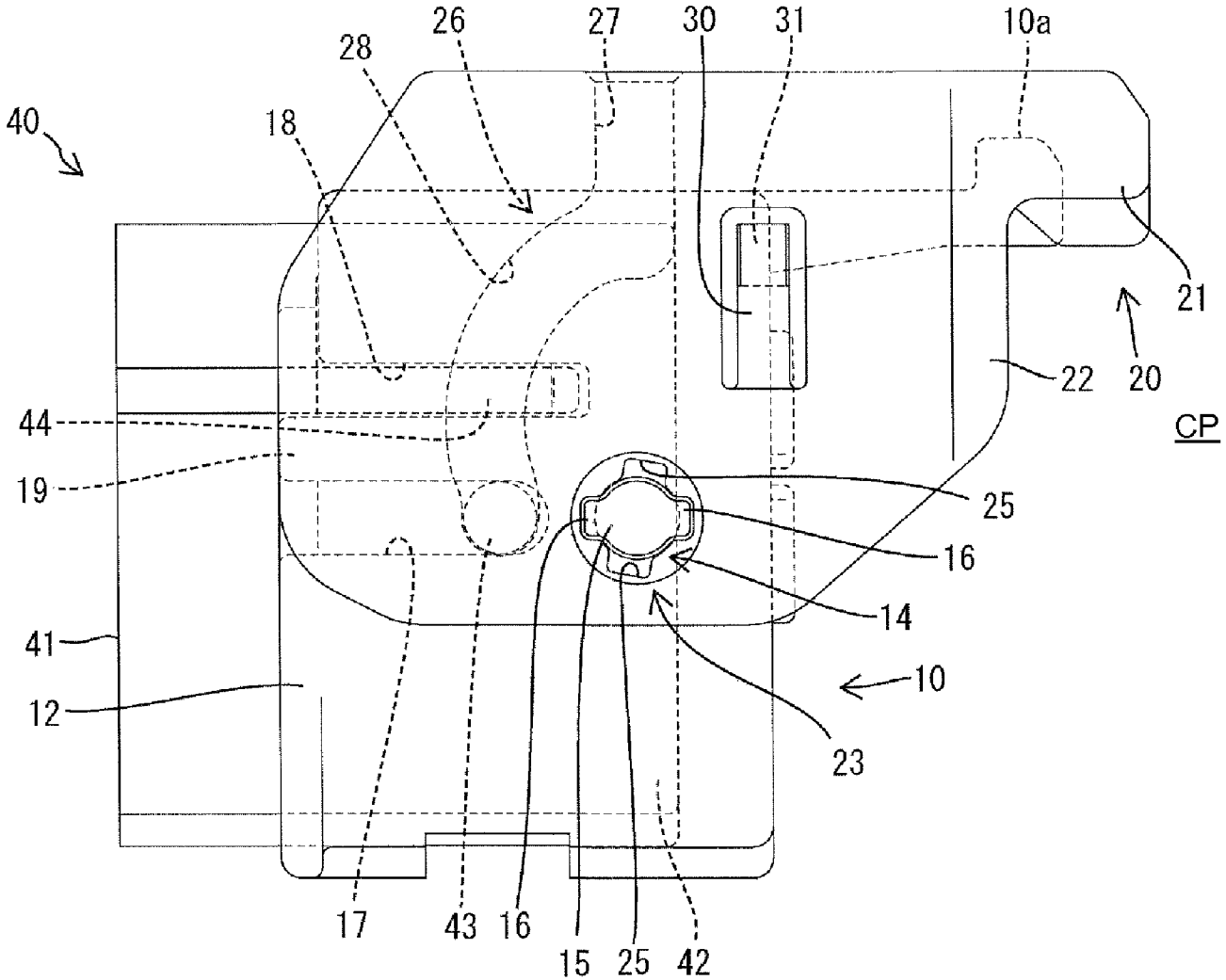
FIG. 10 is a side view showing a state where the both housings are connected by moving the lever to a connection position.
Figure 11:
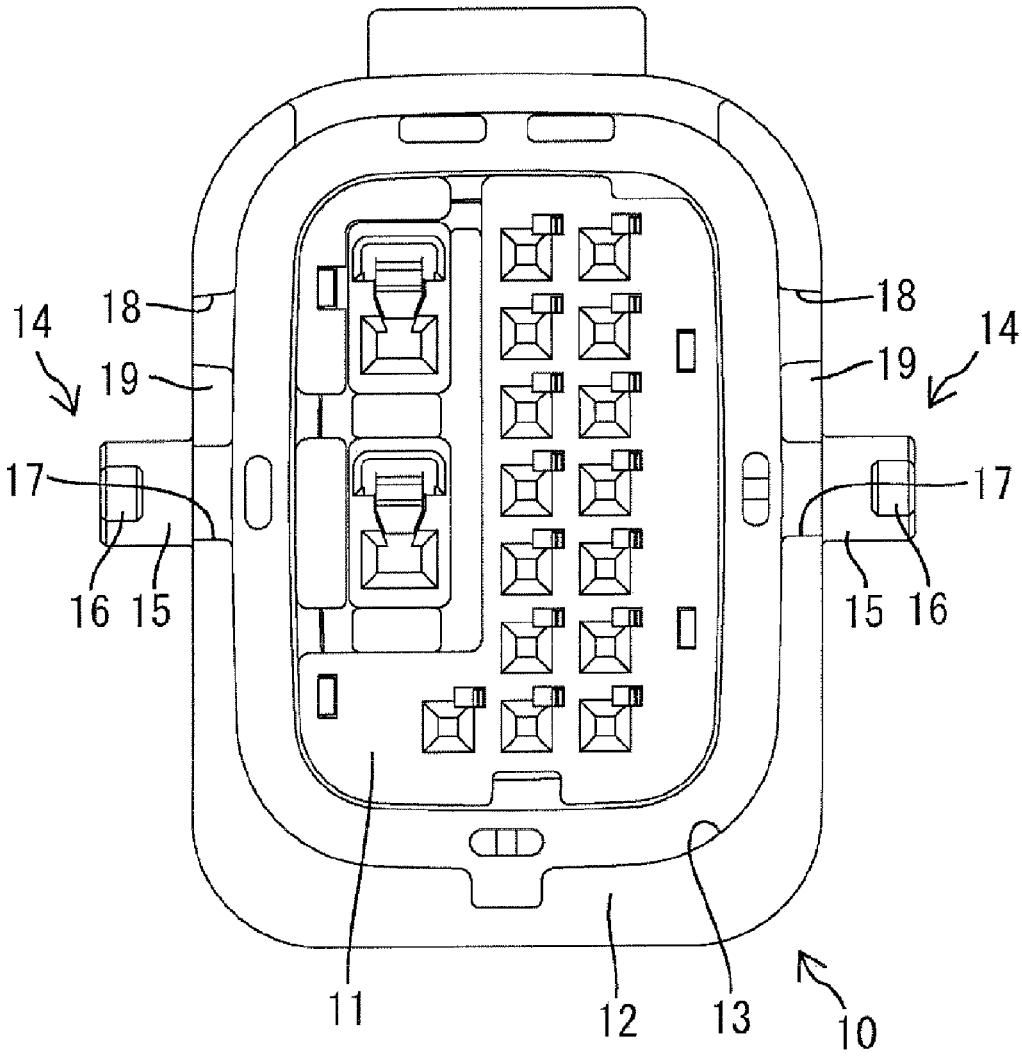
FIG. 11 is a front view of the first housing.
Figure 12:
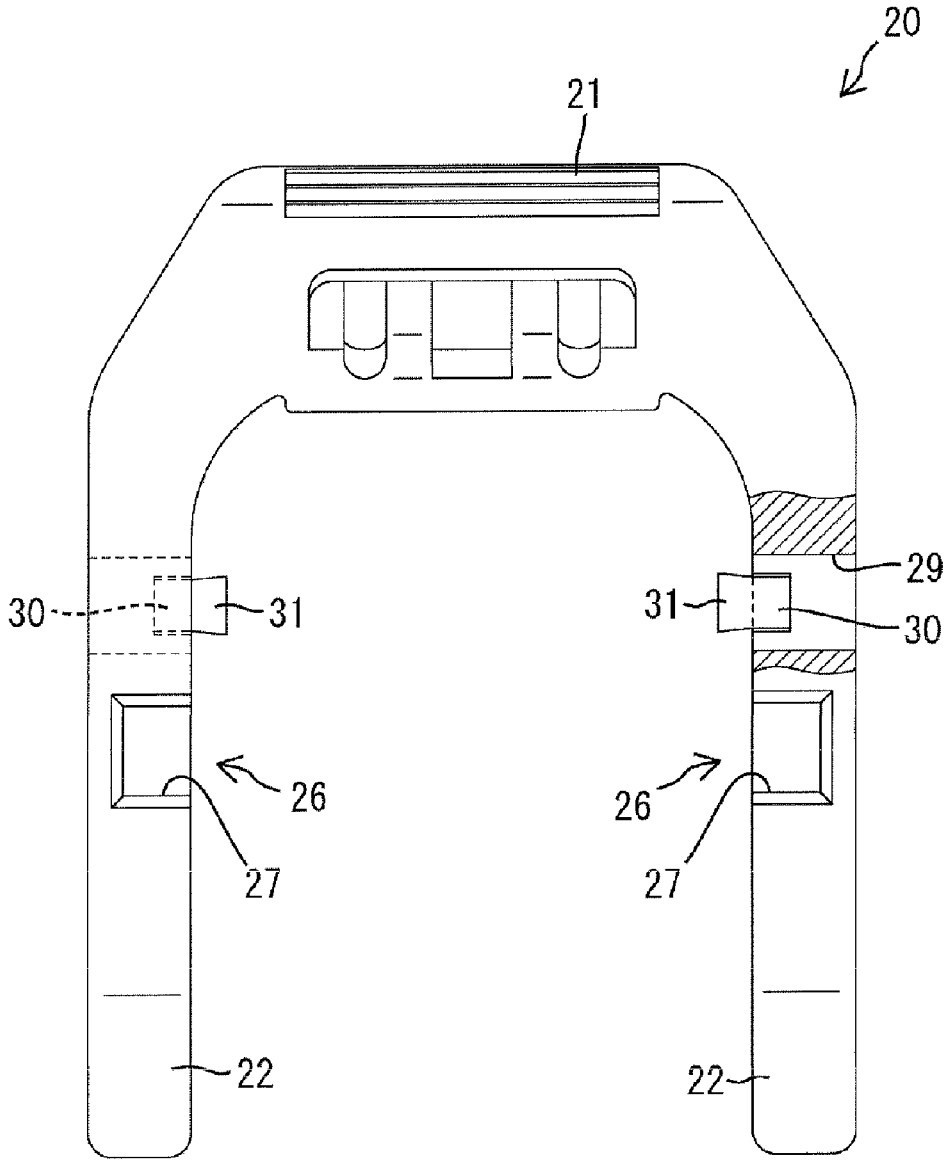
FIG. 12 is a front view of the lever.

The two housings 10, 40 are connected lightly while the receptacle 42 of the second housing 40 is fit partly into the connection space of the first housing 10 with the lever 20 held at the initial position IP. In the fit-in process, the cam followers 43 enter the entrances 27 of the cam grooves 26 and the unlocking ribs 44 enter the locking recesses 18, as shown in FIG. 8. Thus, the unlocking ribs 44 press the inner sides of the resilient arms 30 and deform the resilient arms 30 out in a disengagement direction to disengage the locking projections 31 from the locking recesses 18 as shown in FIG. 9. The disengagement of the locking projections 31 from the locking recesses 18 frees the lever 20 from a rotation prevented state and permits the lever 20 to be rotated toward the connection position CP. Further connection of the two housings 10, 40 is prevented when the cam followers 43 contact the rear ends of the entrances 27.

In this state, the operable portion 21 is gripped to rotate the lever 20 toward the connection position CP. As a result, the cam grooves 26 engage the cam followers 43 to urge the housings 10, 40 together. During this time, the locking projections 31 are disengaged from the unlocking portions 44 and slide on the outer surfaces of the tubular fitting 12 with the resilient arms 30 kept resiliently deformed. Therefore the arms 22 try to displace away from the outer surfaces of the tubular fitting 12 due to resilient restoring forces of the resilient arms 30. However, the retaining projections 16 engage the edges of the bearing holes 23 from the outer sides. Thus, the arms 22 cannot displace away from the outer surfaces of the tubular fitting 12. In this way, the cam grooves 26 and the cam followers 43 are kept engaged.

The two housings 10, 40 are connected properly when the lever 20 reaches the connection position CP and the lever 20 is locked at the connection position CP by the engagement of a lock arm 21*a* on the operable portion 21 and a lock 10*a* at the rear end of the upper surface of the first housing 10. As a result, the two housings 10, 40 are locked in a properly connected state.

As described above, the resilient arms 30 and the resilient escaping portions 19 both deform resiliently away from the mating sides while rotating the lever 20 from the assembled position to the initial position IP. Thus, the degrees of resilient deformation, i.e. resilient restoring forces of the resilient arms 30 are reduced as compared with a case where only the resilient arms 30 deform. Therefore, the lever 20 is held reliably at the initial position IP by suppressing the deformation that could crush the locking projections 31 due to the resilient restoring forces of the resilient arms 30.

The lever 20 is assembled with the first housing 10 from the front in substantially the same posture as at the assembled position AP. Thus, the locking projections 31 contact the resilient escaping portions 19 and the resilient arms 30 and the resilient escaping portions 19 are deformed resiliently in the assembling process. Accordingly, the resilient arms 30 and the resilient escaping portions 19 are deformed resiliently in the process of rotating the lever 20 from the assembled position to the initial position IP and also in the process of assembling the lever 20 with the first housing 10.

Each resilient escaping portion 19 is supported at only one end and therefore is more easily resiliently deformed than a resilient escaping portion supported at both ends, and resilient displacement amounts of the resilient arms 30 are reduced by that much.

The unlocking ribs 44 disengage the locking projections 31 from the locking recesses 18 when the second housing 40 is connected with the first housing 10 so that the lever 20 can be displaced toward the connection position CP. Accordingly, it is not necessary to perform a separate operation of disengaging the locking projections 31 from the locking recesses 18 in addition to the operation of lightly connecting the housings 10, 40.

If the resilient arms 30 and the resilient escaping portions 19 deformed in radial directions toward and away from the supporting shafts 14, the lever 20 and the first housing 10 would be enlarged in radial directions to ensure space for the deformations of the resilient arms 30 and the resilient escaping portions 19. However, the resilient arms 30 and the resilient escaping portions 19 deform in directions substantially parallel to the axes of the supporting shafts 14 to avoid enlargement in radial directions.

The invention is not limited to the above described and illustrated embodiment. For example, the following embodiments are also embraced by the technical scope of the present invention.

In the above embodiment, upon assembling the lever with the first housing, the lever is held in the same posture as at the assembled position and is brought closer to the first housing from front. Thus, the locking projections contact the resilient escaping portions. However, the assembling mode is not limited to this and the lever also can be assembled in a different posture, at a different position and/or along a different movement path, e.g. the lever can be assembled with the first housing from front in a posture different from the one at the assembled position (e.g. posture at the initial position) or the lever can be assembled with the first housing obliquely from the front or above in the same posture as at the assembled position. In these assembling modes, the locking projections may not contact the resilient escaping portions in the assembling process, but the invention also is applicable to such assembling modes.

The locking recesses extend back from the front end of the first housing in the above embodiment. However, they may be closed in the form of windows without opening at the front end of the first housing.

The resilient escaping portions are cantilevered forward in the above embodiment. However, they may be supported at both ends.

The deforming directions of the locking projections and the resilient escaping portions are not limited to those parallel to the axes of the supporting shafts and may deform radially toward and away from the supporting shafts.

The locking projections are disengaged from the locking recesses by the second housing in the above embodiment, but they may be disengaged from the locking recesses separately from the connecting operation.

The cam functioning portions are cam grooves in the above embodiment, but they may be projections (ribs) according to the invention.

The lever is formed with the locking projections and the first housing is formed with the resilient escaping portions in the above embodiment. However, the first housing may be formed with locking projections and the lever may be formed with resilient escaping portions according to the invention.

The invention also is applicable to a lever in the form of a plate having the cam means. Furthermore, the lever may be displaceable along any path, such as a substantially linear or bent path to display the cam action.

What is claimed is:

1. A lever-type connector, comprising: a housing connectable with a mating housing, a supporting shaft formed on the housing and a retaining projection being formed on an outer circumferential surface of a leading end of the supporting shaft;

a lever displaceably mounted on the housing and including a cam functioning portion that is engageable with a cam follower of the mating housing while the lever is at an initial position, the cam functioning portion being configured for generating a cam action with the cam follower for urging the housing and the mating housing toward one another in response to displacing the lever toward a connection position;

a cutout formed on the lever and displaced from the retaining projection of the supporting shaft in the process of displacing the lever between the initial position and the connection position and permitting the passage of the retaining projection only when the lever is at an assembled position;

a resilient arm formed on a first of the housing and the lever and being deformable in a direction intersecting a displacement direction of the lever, the resilient arm including a locking projection;

a locking recess formed in a second of the housing and the lever and being engageable with the locking projection only when the lever is at the initial position; and a resilient escaping cantilever formed on the second of the housing and the lever and being deformable away from the locking projection, the escaping cantilever being slidable on the locking projection while displacing the lever between the assembled position and the initial position; whereby the resilient escaping cantilever reduces an amount of deformation of the resilient arm that is required and reduces a restoring force of the resilient arm for avoiding damage to the locking projection of the resilient arm as the lever is displaced.

2. The lever-type connector of claim 1, wherein the lever has a bearing hole rotatably mounted on the supporting shaft of the housing, the cutout being formed in an inner peripheral surface of the bearing hole.

3. The lever-type connector of claim 1, wherein the resilient escaping portion is at a position before the supporting shaft in a connecting direction of the housing with the mating housing and substantially corresponds to the locking projection in a direction at an angle to the connecting direction of the housing with the mating housing when the bearing hole and the supporting shaft are aligned at the same position to hold the lever in substantially the same posture as at the assembled position with the housing.

4. The lever-type connector of claim 1, wherein deforming directions of the resilient arm and the resilient escaping cantilever are substantially parallel to an axial line of the supporting shaft.

5. The lever-type connector of claim 1, wherein the housing is formed with an escaping groove extending toward the supporting shaft from the front end of the housing for avoiding interference with the cam follower.

6. The lever-type connector of claim 5, wherein the locking recess extends from the front end of the housing and is aligned substantially parallel the escaping groove.

7. The lever-type connector of claim 6, wherein the resilient escaping cantilever is cantilevered substantially forward in an area between the escaping groove and the locking recess.

8. A lever-type connector, comprising:

a housing having opposite front and rear ends, at least one supporting shaft formed on the housing at a position between the front and rear ends, an escaping groove extending rearward from the front end of the housing toward the supporting shaft, a locking recess extending rearward from the front end of the housing and a resilient escaping cantilever between the escaping groove and the locking recess; and a lever mounted on the supporting shaft for rotation from an assembled position to a connection position, the lever including a cam groove having an entrance aligned with the escaping groove when the lever is at an initial position between the assembled position and the connection position, the lever further having a resilient arm formed with a locking projection that deflects the resilient escaping cantilever when the lever is at the assembled position and that engages the locking recess when the lever is in the initial position whereby the resilient escaping cantilever reduces an amount of deformation of the resilient arm that is required and reduces a restoring force of the resilient arm for avoiding damage to the locking projection of the resilient arm as the lever is displaced.

9. The lever-type connector of claim 8, wherein the resilient escaping cantilever is cantilevered substantially forward.

10. The lever-type connector of claim 8, wherein the lever has a bearing hole rotatably mounted on the supporting shaft of the housing, a cutout being formed in an inner peripheral surface of the bearing hole, a retaining projection being formed on an outer circumferential surface of a leading end of the supporting shaft, the cutout permitting the passage of the retaining projection only when the lever is at the assembled position, the cutout being displaced from the retaining projection of the supporting shaft at all rotatable positions of the lever between the initial position and the connection position so that the retaining projection holds the lever on the supporting shaft.

11. The lever-type connector of claim 8, wherein deforming directions of the resilient arm and the resilient escaping cantilever are substantially parallel to an axial line of the supporting shaft.

12. The lever-type connector of claim 8, wherein the locking recess extends from the front end of the housing and is aligned substantially parallel the escaping groove.

13. A connector assembly comprising:

a mating housing having at least one cam follower;

a housing having a front end connectable with the mating housing and a rear end opposite the front end, at least one supporting shaft on the housing between the front and rear ends, an escaping groove extending rearward from the front end of the housing toward the supporting shaft, a locking recess extending rearward from the front end of the housing and a resilient escaping cantilever between the escaping groove and the locking recess; and a lever mounted on the supporting shaft for rotation from an assembled position to a connection position, the lever including a cam groove having an entrance aligned with the escaping groove when the lever is at an initial position between the assembled position and the connection position, the cam groove being engageable with the cam follower of the mating housing while the lever is at the initial position and being configured for generating a cam action with the cam follower for urging the housing toward the mating housing in response to rotating the lever toward the connection position, the lever further having a resilient arm that deflects the resilient escaping cantilever when the lever is at the assembled position and that engages the locking recess (18) when the lever is in the initial position, whereby the resilient escaping cantilever reduces an amount of deformation of the resilient arm that is required and reduces a restoring force of the resilient arm for avoiding damage to the locking projection of the resilient arm as the lever is displaced.

14. The connector assembly of claim 13, wherein the mating housing has an unlocking rib for displacing the locking projection out of the locking recess during connection with the housing.

* * * * *